United States Patent [19]

MacLeish et al.

[11] 4,355,091

[45] Oct. 19, 1982

[54] POLYMERIC NEUTRALIZING LAYER WITH TEMPORARY CROSSLINKS FROM AN ORGANO-METALLIC CROSSLINKING AGENT

[75] Inventors: William T. MacLeish, North Andover; Ehud Shchori, Brookline, both of Mass.

[73] Assignee: Polaroid Corporation, Cambridge, Mass.

[21] Appl. No.: 181,062

[22] Filed: Aug. 25, 1980

[51] Int. Cl.[3] ..... G03C 1/400; G03C 7/00; G03C 5/54

[52] U.S. Cl. ..... 430/216; 204/159.14

[58] Field of Search ..... 430/216; 204/159.14, 204/159.24

[56] References Cited

U.S. PATENT DOCUMENTS

| | | | |
|---|---|---|---|
| 2,683,705 | 7/1954 | Anspon et al. | 204/159.24 |
| 3,118,767 | 1/1964 | Evans et al. | 204/159.24 |
| 3,362,821 | 1/1968 | Land | 96/29 |
| 3,819,371 | 6/1974 | Sahatjian et al. | 96/3 |
| 4,138,260 | 2/1979 | Krafft et al. | 96/77 |

OTHER PUBLICATIONS

Research Disclosure, 7/1974, pp. 22–24.

*Primary Examiner*—John E. Kittle
*Assistant Examiner*—John L. Goodrow
*Attorney, Agent, or Firm*—Louis G. Xiarhos

[57] ABSTRACT

Elements for use in a photographic diffusion transfer process comprising a sheet-like support having a polymeric acid neutralizing layer bonded thereto, wherein said polymeric acid layer is formed from a composition including a crosslinking agent that effects temporary crosslinks within said polymeric layer to promote resistance to aqueous interference during film unit assembly, but which readily hydrolyze under processing conditions so as to accommodate swelling of the polymeric layer in the presence of alkali processing composition.

36 Claims, 3 Drawing Figures

POLYMERIC NEUTRALIZING LAYER WITH TEMPORARY CROSSLINKS FROM AN ORGANO-METALLIC CROSSLINKING AGENT

Diffusion transfer photographic processes are well known in the art. Such processes have in common the feature that the final image is a function of the formation of an imagewise distribution of an image-providing material and the diffusion transfer of said distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image-dye providing material, and transferring this imagewise distribution by diffusion to a superposed image-receiving layer, or positive film component, to impart a transfer image thereto.

The negative and positive components of a diffusion transfer photographic system may be separate elements which are brought together during processing and thereafter either retained together as the final print or separated following image formation; or, they may together comprise a unitary structure, an integral film unit wherein the negative and positive components are physically retained together prior to exposure and following image formation.

The image-dye providing materials which may be employed in diffusion transfer photographic processes generally may be characterized as initially soluble or diffusible in the processing composition but selectively rendered nondiffusible in an imagewise pattern as a function of development, or as initially insoluble or nondiffusible in the processing composition but selectively rendered diffusible in an imagewise pattern as a function of development. These materials may contain complete dyes or dye intermediates, e.g., color couplers.

A particularly useful class of image-dye providing materials for diffusion transfer processes are dye developers. These compounds contain, in the same molecule, both the chromophoric system of a dye and also a group adapted to develop exposed photographic silver halide. Although the principles presented are readily adaptable to other diffusion transfer processes, in order to simplify the presentation herein, a preferred diffusion transfer photographic process utilizing dye developer image-dye providing materials has been selected to be discussed in more specific detail below.

Multicolor images in a diffusion transfer system can be obtained by arranging a photosensitive element with at least two silver halide layers selectively sensitized to different regions of the spectrum. Such a system is shown, for example, in U.S. Pat. No. 2,983,606. To accomplish subtractive color photography, associated with each silver halide layer is a dye developer featuring an absorption that is substantially complementary in color to the color of the light recorded in the contiguous silver halide layer. The most commonly employed arrangement of this type includes three monochrome units—a blue-sensitive silver halide layer overlying a yellow dye developer, a green-sensitive silver halide layer overlying a magenta dye developer and a red-sensitive silver halide layer overlying a cyan dye developer.

Such an exposed photosensitive element is processed using an aqueous alkaline processing composition containing an alkali, such as potassium hydroxide. The processing composition penetrates the layers of the negative element and dissolves the dye developer compounds by ionizing the developer groups. In each silver halide layer, where the silver halide has been exposed and developed, the dye developer becomes insoluble or at least substantially immobile. In unexposed regions of silver halide, the solubilized dye developer diffuses through the overlying layers to an image-receiving layer to form a positive multicolor image.

The processing compositions employed in diffusion transfer processes are usually highly alkaline (i.e., pH>12). However, after processing has been allowed to proceed for a predetermined period of time, it is desirable to neutralize the alkali of the processing composition. Accordingly, a neutralizing layer, typically a nondiffusable acid-reacting reagent, is employed in the film unit to lower the pH from a first (high) pH of the processing composition to a predetermined second (lower) pH.

In order to ensure that the pH reduction occurs after a sufficient, predetermined period and not prematurely so as to interfere with the development process, the neutralizing layer preferably is positioned behind a diffusion control time modulating layer. Ideally, this time modulating layer should initially be impermeable to alkali and then, after a brief predetermined period, should allow alkali to penetrate it readily to be depleted by the neutralizing layer and thereby shut-down the devlopment process.

As disclosed in, for example, U.S. Pat. No. 3,362,819, issued Jan. 9, 1968 to E. H. Land, the acid neutralizing layer may comprise a nondiffusible polymeric acid-reacting reagent adapted to lower the pH from a first (high) pH of the processing composition to a predetermined second (lower) pH. The acid-reacting reagents are preferably polymers which contain acid groups, e.g., carboxylic acid and sulfonic acid groups which are capable of forming salts with alkali metals or with organic bases or potentially acid-yielding groups such as anhydrides or lactones. Preferably the acid polymer contains free carboxyl groups. As examples of useful neutralizing layers, in addition to those disclosed in the aforementioned U.S. Pat. No. 3,362,819, mention may be made of those disclosed in the following U.S. patents: Land U.S. Pat. No. 3,362,819; Bedell U.S. Pat. No. 3,765,885; Sahatjian et al. U.S. Pat. No. 3,819,371; Haas U.S. Pat. No. 3,833,367; and Taylor U.S. Pat. No. 3,756,815.

The polymeric acid neutralizing layer may be variously positioned within a diffusion transfer photographic film unit. In one embodiment, the neutralizing layer forms a part of an image-receiving element and is disposed between the support sheet and the image-receiving dyeable stratum. Alternatively, the polymeric acid neutralizing layer may be positioned in the negative element adjacent the support sheet, separating the support from the innermost dye developer layer of the photosensitive strata.

Depending on its specific location within the photographic film unit, the neutralizing layer is subject to varying conditions during film unit assembly. In arrangements where the neutralizing layer is overcoated with an aqueous based strata, such as the above-described arrangement where the neutralizing layer is disposed within the negative element in association with the photosensitive strata, it has been observed that presence of the neutralizing layer has introduced problems in drying the completed negative structure. Incomplete drying of the negative often is evidenced by reduced physical integrity, degraded appearance and diminished photographic performance in the film unit.

Now, according to the present invention, a polymeric acid neutralizing layer is prepared from a composition including a temporary crosslinking agent. This temporary crosslinking agent stabilizes the polymeric acid to such a degree that it is substantially unaffected by aqueous association during film unit preparation and, in turn, does not interfere with drying operations. Further, the crosslinking effect appears to accelerate the cure rate of the polymeric material so as to reduce residual monomers as well as other water extractable species in the resulting polymer layer.

It is theorized that the hydrophilic nature of the polymeric acid neutralizing layer results in an uptake of water, or swelling, by this polymeric layer during coating when it is positioned in a film unit in an arrangement associated with aqueous based strata, such as in the negative element. Accordingly, in such an arrangement, the swelling of the neutralizing layer serves to retain moisture and interfere with the normal drying of the completed negative structure. Drying conditions effective to promote desired drying of the swollen neutralizing layer may have an adverse influence upon the proper functioning of photosensitive emulsion layers or other layers in a photographic film unit.

Modifying the neutralizing layer to impart hydrophobicity would tend to relieve the described drying problem. However, hydrophobicity would seriously debase capability of the polymeric acid to function as a neutralizing layer during film unit processing. Swelling of the polymeric acid layer is an integral part of the neutralizing operation wherein the alkali processing composition is depleted after completion of development, in order to shut down the process.

The present invention solves this problem by introducing temporary crosslinks into the polymeric acid structure. This crosslinking promotes resistance to swelling from association with aqueous strata during film unit preparation. In addition, crosslinking offers the benefit of serving to reduce migration of residual fugitive species within the polymer structure. These fugitive or mobile species may adversely affect the diffusion transfer process as a result of their migrating character and, hence their presence is desirably avoided.

The temporary crosslinks are, however, hydrolyzed under alkaline conditions. Accordingly, in the presence of the alkaline processing composition, the crosslinks of the polymeric acid layer are broken. By severing the crosslinks, the layer is unencumbered in its neutralizing function. Swelling appears to facilitate the uptake of alkali and other mobile species by the polymeric acid layer. The uniformity of swelling permitted by the lack of permanent crosslinks avoids lacing, or reticulation, which appears as an irregular buckling, surface effect in permanently crosslinked polymeric acid layers.

In photographic diffusion transfer products containing a polymeric acid neutralizing material for desired pH control, it has been customary to apply such material to a suitable support sheet with the polymeric acid in an aqueous or organic solvent and drying the resulting coating for solvent removal and provision of the desired polymeric acid layer. Depending on compatability with the particular polymeric acid composition and chosen application scheme, any suitable crosslinking agent may be used in preparing the subject polymeric acid layer. The crosslinks must be resistant to non-alkaline hydrolysis but rapidly degrade under alkaline conditions that occur during film processing.

Recently, there has been an increasing interest in and more widespread use of radiation induced polymerization reaction. The growling interest in the utilization of electron-beam and ultra-violet systems, for example, as a means of inducing desired polymerization reactions, has largely been the result of the potential for reduced power consumption and the increased availability and effectiveness of radiation-providing apparatus and systems. In addition, the utilization of radiation-induced polymerization may offer the advantages of improved production rates and economy of operation relative to costs associated with conventional solvent removal and recovery techniques.

The preferred polymeric acid neutralizing layer, according to the present invention, is prepared by radiation polymerization of a radiation-polymerizable composition comprising an effective amount of an organometallic compound which forms temporary crosslinks within the polymeric acid layer in order to reduce the residual fugitive species and to promote resistance to aqueous interaction during film unit assembly, but which substantially hydrolyze under processing conditions to accommodate swelling of the polymeric acid layer in the presence of alkali processing composition.

The organometallic compounds may include materials such as aluminum, calcium, zinc, silicon, tin and other amphoteric and transitional metal compounds, including oxides, hydroxides and carboxylates, and mixed alkyl and polyalkyl metallic oxides, hydroxides and carboxylates. The preferred organometallic compounds are organo-tin compounds, which include materials such as dibutyltin diacetate, stannous octoate, stannous oxalate, dioctyltin oxide, diphenyltin oxide, dibutyltin oxide, butylchlorotin dihydroxide, butyl stannoic acid, dialkyltin diacetate, dialkyltin dilaurate, and the like.

Particularly preferred crosslinkers are dibutyltin oxide, dioctyltin oxide and butyl stannoic acid.

Using the preferred radiation-polymerized polymeric acid layer for more detailed illustration, the polymeric acid neutralizing layers are formed by the radiation-induced polymerization of a radiation-polymerizable composition comprising an ethylenically unsaturated acid or anhydride. Such acids typically include ethylenically unsaturated carboxylic and sulfonic acids, such as acrylic acid, methacrylic acid, 3-chloro-2-methyl acrylic acid, 3-butenoic acid, 4-pentenoic acid, 2-hexenoic acid, ethyleneglycolacryate succinate, ethyleneglycolacrylate phthalate, acrylamidoglycolic acid, 2-acrylamido-2-methyl propane sulfonic acid, N-acryloyl-2-methyl alanine, corresponding anhydrides and mixtures thereof. Commonly, a comonomer is employed in the composition in order to impart favorable properties. Such comonomers include a mono-N-substituted acrylamide and an acrylate or methacrylate ester. The preparation of such radiation polymerized polymeric acid neutralizing layers is more fully described in copending, commonly assigned U.S. patent applications Ser. Nos. 42,902 and 42,903, both filed May 29, 1979.

The preferred radiation-polymerizable composition is a mixture of acrylic acid and a comonomer selected from diacetone acrylamide, t-octyl acrylamide, or mixtures thereof. The mixture of acrylic acid and comonomer generally is used in a molar ratio ranging from about 0.5:1 to about 15:1.

The crosslinker is used in an amount sufficient to ensure effective crosslinking in the polymeric acid material, e.g., sufficient to effect the desired degree of resistance to swelling and/or residuals reduction. Experimentation has indicated that a level of crosslinker in the radiation-polymerizable composition ranging from about 5 to about 25 weight percent produces favorable results; about 5 to about 10 percent is preferred.

The acid-reacting polymeric layer bonded to the support material on which it is polymerized can be formed by applying the radiation-polymerizable composition to the support material and effecting polymerization thereof by subjecting the support and coating to a suitable form of polymerizing irradiation. The nature of the support employed will depend upon the particular application contemplated for the resulting support carrying the polymeric acid-reacting layer. Typically, the support material will comprise a support onto which the radiation-polymerizable composition can be suitably applied for polymerization and will include glass, paper, metallic and polymeric support materials derived from naturally occuring products or of a synthetic type. Thus paper; aluminum; methyl and ethyl esters of polymethacrylic acid; vinly chloride polymers; polyvinyl acetal; polyamides such as nylon, polyesters such as ethylene glycol terephthalate or such cellulosic derivatives as cellulose acetate, triacetate, nitrate, propionate, butyrate, acetate-propionate or acetate butyrate can be employed. It will be apparent that depending upon the desired application of the substrate material carrying the polymeric acid-reacting layer, the nature of the substrate material as a transparent, translucent or opaque support will be a matter of choice. It will be appreciated that, in the case of photographic applications where a photographic image is desirably viewed through the substrate carrying the acid-reacting polymeric layer, a transparent support material will be utilized. A preferred support material is a transparent web or sheet material onto which the radiation-polymerizable composition can be suitably applied and polymerized with the provision of a transparent element suited to such application.

The support material can, where desired, be subjected to a pretreatment step prior to the application and polymerization of the radiation-polymerizable composition. Such pretreatment step can be employed to facilitate adhesion between the polymeric layer and the support material and can comprise, for example, a corona discharge treatment as is known in the art. Polymeric layers, of vinylidene chloride, gelatin, polyvinyl alcohol or the like can be utilized as sub-coats onto which the acid-reacting polymeric layer is formed. Such pretreatment or utilization of sub-coats need not, however, be employed and the radiation-polymerizable composition can be applied to the substrate material without such pretreatment or sub-coats with formation of the desired polymeric layer by in situ polymerization as herein described.

The radiation-polymerizable composition can be applied to the support material on which it is polymerized and bonded in any of a number of ways. For example, the composition can be applied to the substrate material by roll coating, gravure coating, extrusion coating, doctor-blade coating, air-knife coating, curtain coating, or the like. A preferred means for effecting the application of the radiation-polymerizable composition onto the support material involves advancing a continuous web or sheet of support material through a coating zone in which the radiation-polymerizable composition is applied in a uniform and continuous manner utilizing any of the aforesaid coating techniques. The viscosity of the radiation-polymerizable composition applied to the substrate material will vary depending upon the particular monomeric components thereof and their relative porportions. In general, the composition will be applied to the support material in the form of a relatively thin coating and the relative conformation of the applied coating will be retained as the substrate carrying the coating is advanced to the polymerizing or curing operation.

The amount of radiation-polymerizable composition applied to the substrate material will vary with the particular composition employed, the desired level of acid-reacting functionality, the coating technique utilized, the conditions utilized in the polymerization or curing thereof, particularly the radiation dose, and the particular use or application contemplated for the polymer-carrying substrate material. Normally, acid-reacting polymeric layers exhibiting good adhesion properties and low levels of water-extractable components can be conveniently obtained by applying to a suitable substrate material for subsequent radiation polymerization a thin coating of the radiation-polymerizable composition. In accordance with a preferred embodiment of the invention, a coating of radiation-polymerizable composition will be applied to a suitable support material in an amount sufficient to provide the desired acid-reacting functionality, usually from about 10 to about 25 milliequivalents of neutralization capacity per square foot (about 108 to about 269 meq/$m^2$, and preferably, from about 14 to about 20 meq/$ft^2$ (about 151 to about 215 meq/$m^2$).

The radiation-polymerizable composition can be polymerized or cured to a solid acid-reacting layer by resort to any of a variety of known techniques for effecting radiation polymerization or curing of radiation-polymerizable or curable compositions. Apparatus and methods for effecting such polymerization or curing are well known and include, for example, the utilization of actinic radiation such as ultra-violet radiation of suitable intensity and high-energy ionizing radiation such as X-rays, gamma rays, beta rays and accelerated electrons. Typically, the radiation utilized will be of a sufficient intensity to penetrate substantially the coated layer of radiation-polymerizable composition and the dosage employed will be sufficient to effect the polymerization of the radiation-polymerizable composition to a solid or nontacky polymeric layer. The amount of radiation employed will, however, vary with the thickness of coating and the speed with which the coated substrate is advanced through the irradiation zone. Typically, a dosage in the range of from about 1 to about 10 megarads, and more usually in the range of from about 2 to about 6 megarads, will be employed. Single or multiple passes can be utilized to effect polymerization of the radiation-polymerizable composition.

The polymerization of the radiation-polymerizable composition by the utilization of ionizing radiation can be effected by subjecting the composition on a suitable substrate to irradiation as the result of bombardment of a metallic target such as tungsten, with electrons of high energy conferred by potential accelerators of over 0.1 million electron volts (mev.). Typically, an electron beam will be provided as a single-point electron beam or in the form of a curtain from a wire filament electron source. Examples of commercially available sources of ionizing electromagnetic irradiation include such equipment as the ARCO-type travelling wave accelerator, Model Mark I, operating at 3 to 10 million electron volts, such as supplied by High Voltage Engineering Corp., Burlington, Massachusetts; and other accelerators as described in U.S. Pat. No. 2,763,609 and in British Pat. No. 762,953.

While the utilization of ionizing electromagnetic irradiation in the form of an ion beam constitutes a preferred practice of the invention, it is intended that ionizing radiation inclusive of ionizing particle radiation can also be employed. The term "ionizing particle radiation" is used herein to designate the emission of electrons or highly accelerated nuclear particles such as protons, neutrons, alpha particles, deuterons, beta particles, or their analogs, directed in such a way that the particle is projected into the mass to be irradiated. Charged particles can be accelerated by the aid of voltage gradients by such devices as accelerators with residence chambers, Van der Graaff generators, betatrons, synchrotons, cyclotrons, or the like. Neutron radiation can be produced by bombarding a selected light metal such a berylium with positive particles of high energy. Particle radiation can also be obtained by the use of an atomic pile, radioactive isotopes or other natural or synthetic radioactive materials.

The polymerization of the radiation-polymerizable composition can be effected in the presence of an inert atmosphere so as to minimize the inhibitory effects of oxygen. Accordingly, the copolymerizable mixture can be applied in a coating zone which is substantially oxygen-free by utilization of an inert gas flush or purge, e.g., a nitrogen purge. Similarly, the polymerization reaction can be effected by irradiating the copolymerizable mixture in an inert atmosphere and the polymerized coating can be advanced into an inert atmosphere until the temperature of the polymer-containing substrate approaches ambient temperature. Additives in the nature of oxygen scavengers, e.g., triphenyl phosphine, can also be utilized and can conveniently be employed in the comonomeric polymerizable composition as a means of minimizing the polymerization-retarding or inhibiting effects of oxygen.

Additional components, e.g., photoinitiators as described hereinbefore, UV stabilizers, opacification agents, plasticizers, surface-active agents or the like, can also be employed for their known purposes in the radiation-polymerizable compositions utilized herein. Preformed polymers can be employed to facilitate coatability, to provide hydrophobicity or the like. Suitable polymeric materials for addition to the copolymerizable composition include cellulosic derivatives such as cellulose acetate butyrate or ethyl cellulose.

The invention may be further understood by reference to the figures.

Figure 1:
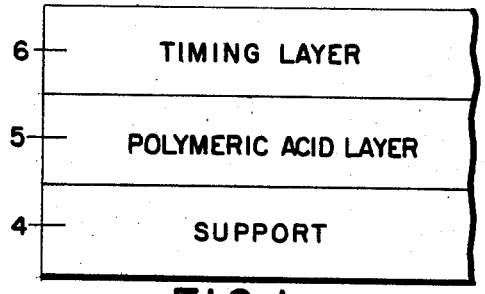
FIG. 1 is a magnified, diagrammatic, cross-linked sectional view of an article of the invention comprising a support sheet having bonded thereto a temporarily cross-linked polymeric acid layer of the present invention.

Referring to FIG. 1, there is shown a coated article of the invention 50 comprising support material 4 carrying a layer of polymeric acid neutralizing layer 5 including temporary crosslinks as herein defined. Support material 4 can comprise any of the support materials described hereinbefore. Depending upon the particular application intended for the polymer layer-containing article, support 4 can be opaque, translucent or transparent. A preferred application of article 50 is in the manufacture of diffusion transfer film units of the types shown in FIGS. 2 and 3 described in greater detail herein after. It will be preferred for such applications that support 4 be a transparent and dimensionally stable sheet-like support material in the nature of polyethylene glycol terephthalate or the like. Article 50 is shown in FIG. 1 as including a timing layer 6. Such a layer is optional and the nature and function of such layer in diffusion transfer processing is known and described in greater detail hereinafter.

Figure 2:
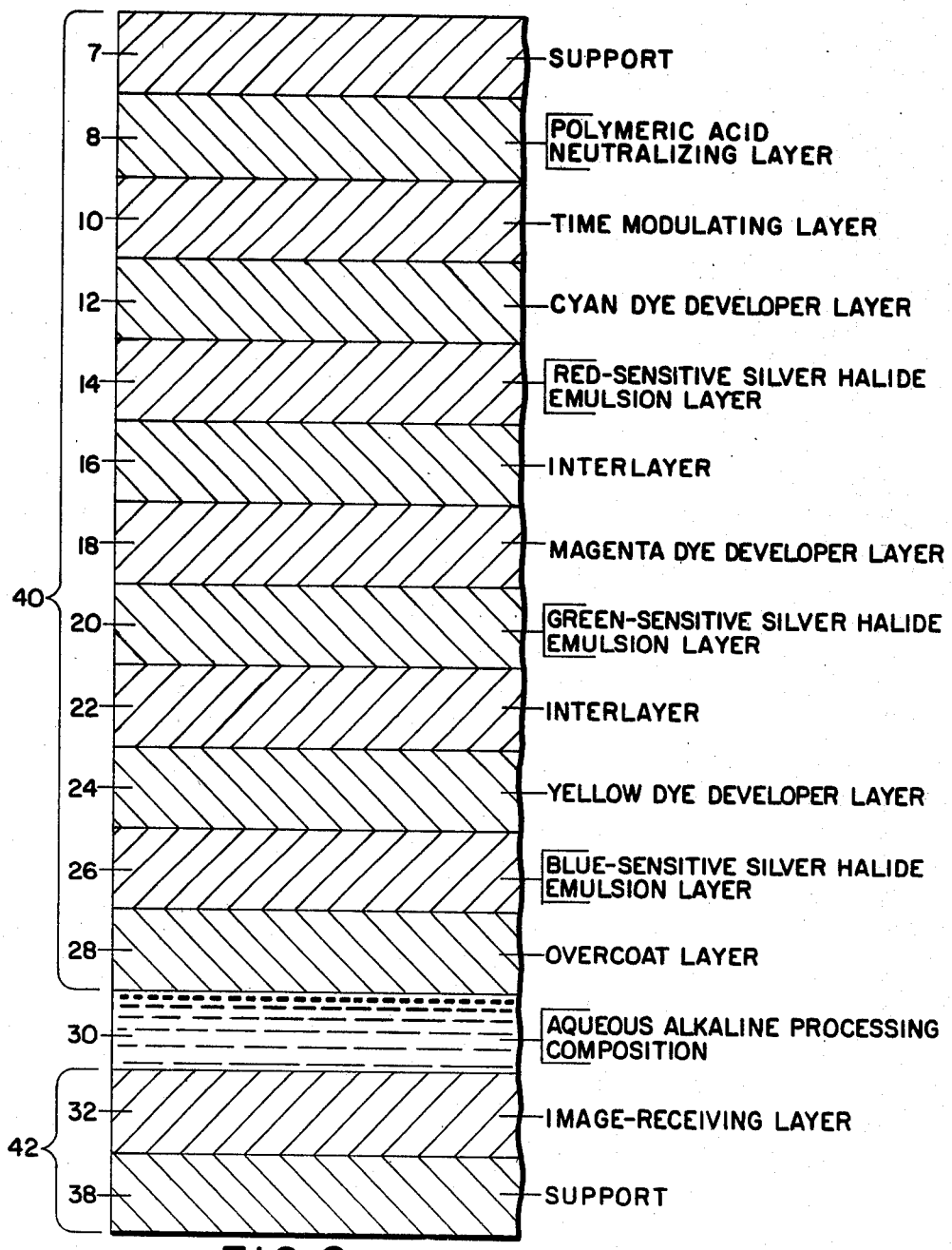
FIG. 2 is a magnified, diagrammatic, sectional view of a preferred diffusion transfer photographic film unit.

Referring to FIG. 2, element 40 represents a photosensitive, or negative, film component which comprises a support layer 7, a polymeric acid neutralizing layer 8, a time modulating layer 10, a cyan dye developer layer 12, a red-sensitive silver halide emulsion layer 14, a diffusion control interlayer 16, a magenta dye developer layer 18, a green-sensitive silver layer 20, a second interlayer 22, a yellow dye developer layer 24, a blue-sensitive silver halide emulsion layer 26 and a protective overcoat layer 28.

As illustrated in the figure, the multilayer photosensitive element 40 has been selectively exposed to actinic radiation and is depicted in processing relationship with an image-receiving element 42 and a layer of processing composition 30 which has been distributed intermediate negative element 40 and positive element 42. Image-receiving element 42 may be a separate component or may be part of a permanently integral unit with the negative element.

Image-receiving or positive elment 42 is shown comprising support 38 and an image-receiving layer 32.

Following exposure of negative element 40, aqueous alkaline processing composition 30 is applied to initiate development of the image. As the alkali penetrates the various layers of the negative, it reaches and solubilizes the dye developers in layers 24, 18 and 12. When they are solubilized, the dye developers are capable of moving from their original positions. However, interlayers 16 and 22 preferably are selectively permeable and initially bar passage of the dye developers and restrict their migratory movement to within their associated, complementary silver halide layers. Accordingly, the yellow dye developer of layer 24 interacts with the exposed blue-sensitive silver halide of layer 26, the magenta developer of layer 18 interacts only with the exposed green-sensitive silver halide of layer 20 and the cyan dye developer of layer 12 interacts with the exposed red sensitive silver halide of layer 14. Where development occurs the dye developer is immobilized.

The silver halide emulsion layers 14, 20 and 26 of the photosensitive element preferably comprise optionally sensitized silver halide, e.g., silver chloride, bromide or iodide, or mixed silver halides, such as silver iodobromide or chloroiodobromide dispersed in a suitable colloidal binder, such as gelatin. Such layers may typically be on the order of 0.6 to 6 microns in thickness. It will be appreciated that the silver layers may, and, in fact, generally do contain other adjuncts, e.g., chemical sensitizers such as are disclosed in U.S. Pat. Nos. 1,574,944;

1,623,499; 2,410,689; 2,597,951; 2,487,850; 2,518,698; 2,521,926; etc., as well as other additives performing specific desired functions, e.g. coating aids, hardeners, viscosity-increasing agents stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

Optical sensitization of the emulsion's silver halide crystals may be accomplished by contact of the emulsion composition with an effective concentration of optical sensitizing dyes selected to impart sensitivity to the silver halide in predetermined regions of the electromagnetic spectrum, e.g., red, green and blue; all according to the traditional procedures of the art, as described in, for example, Hamer, F. A., *The Cyanine Dyes and Related Compounds.*

The respective dye developers may be any of those in the aforementioned U.S. Pat. No. 2,983,606 and numerous other U.S. patents. As examples of U.S. patents detailing specific preferred "metallized" dye developers, mention may also be made of U.S. Pat. Nos. 3,563,739 and 3,551,406 (magenta dye); U.S. Pat. Nos. 3,597,200 and 3,705,184 (yellow dye); and U.S. Pat. No. 3,482,972 (cyan dye). The dye developers are preferably dispersed in an aqueous alkaline solution permeable polymeric binder, e.g., gelatin or a synthetic film-forming polymer such as disclosed in a multiplicity of prior patents, e.g., U.S. Pat. Nos. 2,992,104; 3,043,692; 3,069,203; 3,061,428; 3,044,873; 3,069,264, etc.

The interlayer materials that may be used comprise alkaline permeable polymeric material such as gelatin and other materials such as those disclosed in U.S. Pat. Nos. 3,421,892; 3,575,701; 3,615,422 and 3,625,685. The interlayers may also contain additional reagents performing specific functions, e.g., various ingredients necessary for development may be contained initially in such layers in lieu of being present initially in the processing composition.

The overcoat layer 28 preferably is a protective layer of gelatin or any suitable alkali permeable material. If desired, it may contain various additives, or it may even comprise diffusion control material which serves as a barrier to premature dye developer migration to the image-receiving layer.

The liquid processing composition 30 introduced for effecting multicolor diffusion transfer processes comprises at least an aqueous solution of an alkaline material, for example, sodium hydroxide, potassium hydroxide, and the like, and preferably possessing pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose of sodium carboxymethyl cellulose. Other film-forming materials or thickening agents whose ability to increase viscosity is substantially unaffected if left in solution for a long period of time are also capable of utilization. The film-forming material is preferably contained in the processing composition in such suitable quantities as to impart to the composition a viscosity in excess of 100 cps. at a temperature of approximately 24° C. and preferably in the order of 10,000 cps. to 100,000 cps. at that temperature.

A rupturable container of known description contains the requisite processing composition and is adapted upon application of pressure to release its contents for development of the exposed film unit, e.g., by distributing the processing composition in a substantially uniform layer between a pair of predetermined layers. As shown in the figure, the processing composition is introduced as a layer 30 between overcoat layer 28 of the negative and image-receiving layer 32 of the positive element.

The yellow dye developer is not impeded in its migration towards the image-receiving layer and proceeds to migrate immediately upon solubilization. After a delay provided by interlayers 16 and 22, the solubilized magenta and cyan dye developer compounds in the unexposed regions of silver halide also are free to pass through the overlaying emulsion and on through the other layers into the image-receiving layer 32 where the dye developers are captured by a polymeric mordant and thereby impart thereto a positive dye transfer image.

As has been noted above, following image formation, the image-receiving element 42 may be separated from the photosensitive element 40 or it may remain permanently integral therewith.

The supports 7 and 38 for the respective elements may be opaque or transparent, as desired, and may comprise any of the materials heretofore employed for such a purpose, e.g., paper base materials, ethylene glycol terephthalic acid, vinyl chloride polymers, polyvinyl acetate, polyamides, polymethacrylic acid methyl and ethyl esters, cellulose derivatives such as cellulose acetate, triacetate, nitrate, propionate, butyrate acetate or acetate butyrate, crosslinked polyvinyl alcohol, etc.

The image-receiving layer 32 generally comprises a dyeable material which is permeable to the alkaline processing composition. The dyeable material may comprise polyvinyl alcohol together with a polyvinyl pyridine polymer such as a poly-4-vinyl pyridine polymer. Such image-receiving layers are further described in U.S. Pat. No. 3,148,061 to Howard C. Haas. A preferred image-receiving layer material comprises a graft copolymer of 4-vinylpyridine, vinylbenzyl-trimethylammonium chloride grafted on hydroxyethyl cellulose. Such graft copolymers and their use as image-receiving layers are further described in U.S. Pat. Nos. 3,756,814 and 4,080,346 issued to Stanley F. Bedell.

The polymeric acid neutralizing layer 8 comprises the temporary crosslinked material of the present invention. The neutralizing layer is adapted to lower the pH from a first (high) pH of the processing composition to a predetermined second (lower) pH.

A diffusion control time modulating layer 10 may be and is preferably disposed between the polymeric acid layer and the innermost dye developer layer in order to control the pH reduction so that it is not premature and hence will not interfere with the development process, e.g., to "time" control the pH reduction. Preferably, the diffusion control polymer layer of the present invention is employed as this time modulating layer. Suitable other spacer or "timer" layers for this purpose are described with particularly in U.S. Pat. No. 3,362,819 and in others, including U.S. Pat. Nos. 3,419,389; 3,421,893; 3,433,633; 3,455,686; 3,575,701; 3,785,815 and 3,856,522.

Figure 3:
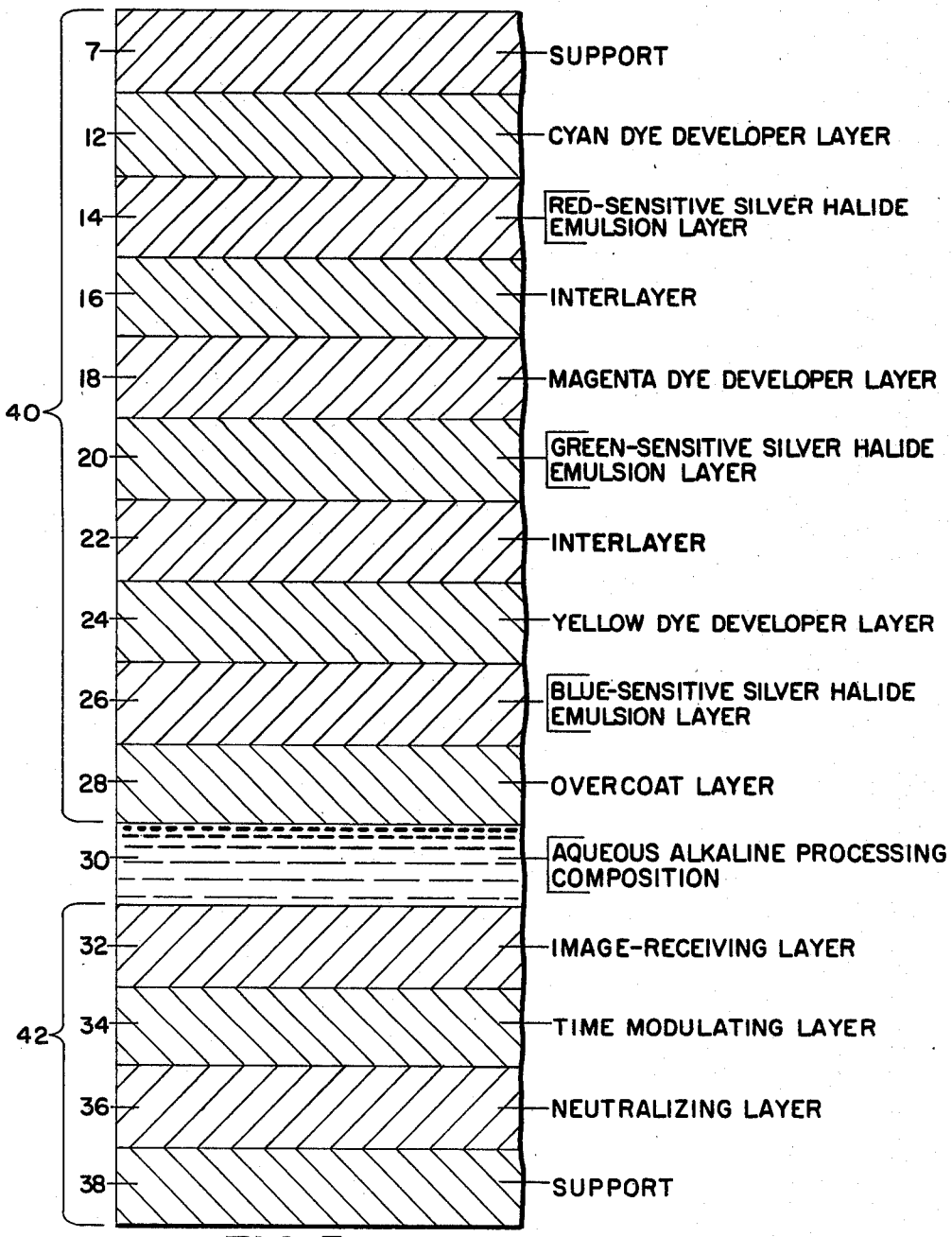
FIG. 3 is a magnified, diagrammatic, sectional view of an alternate arrangement for a diffusion transfer photographic film unit.

In an alternative embodiment shown in FIG. 3, a polymeric acid neutralizing layer 36 may be positioned in the positive element 42, adjacent support layer 38, separating the support from the image-receiving layer 32. Preferably, a spacer or time modulating layer 34 is disposed between the polymeric acid layer and the image-receiving layer to prevent premature pH reduction. The polymeric acid layer in the positive element may serve either as a replacement or as a supplement for the polymeric acid layer in the negative element.

The arrangement and order of the individual layers of the diffusion transfer film units described herein may vary in many ways as is known in the art, provided the film units comprise a polymeric acid neutralizing layer bonded to a suitable support or sheet-like element thereof. For convenience, however, the more specific descriptions of the invention hereinbefore set forth were by use of dye developer diffusion transfer color processes and of diffusion transfer film units of the type generally contemplated in previously mentioned patents. Thus, details relating to integral negative-positive film units of the type described hereinbefore can be found in such patents as U.S. Pat. Nos. 3,415,644; 3,362,821 and 3,647,437.

Integral negative-positive film units of another type, as described, for example, in U.S. Pat. No. 3,594,165, include a transparent support, carrying the appropriate photosensitive layers and associated image-dye providing materials, a permeable opaque layer, a permeable and preformed light-reflecting layer, and means for distributing a processing composition between the photosensitive layer and a transparent cover or spreader sheet carrying a polymeric acid neutralizing layer as herein described. Integral negative-positive film units of this type include an opaque processing composition which is distributed after photoexposure to provide a second opaque layer which can prevent additional exposure of the photosensitive element. In film units of this type, exposure is made through the transparent cover or spreader sheet. The desired transfer image is viewed against the reflecting pigment-containing layer through the transparent support element.

Regardless of the particular arrangement or order of the individual layers of the diffusion transfer film unit, the polymeric acid neutralizing layer of the present invention, having a temporarily crosslinked structure, serves to provide the feature of accommodating coating thereon of aqueous based layers, such as aqueous-based time-modulating layers or emulsion layers. The reduced swellability of the neutralizing layer when in association with aqueous based layers during film unit fabrication facilitates proper drying and reduces related incompatibility problems.

It will be understood that although the invention has been illustrated by the use of electron beam polymerization in situ, the invention also is applicable to the use of preformed polymers, the alkali hydrolysable cross-linking agent is added during the coating step.

The following examples are illustrative of the present invention and are not intended to be limiting in nature.

EXAMPLE I

A polyester sheet material having a temporary crosslinked radiation-polymerized polymeric acid layer bonded thereto was prepared in the following manner. A series of runs was conducted utilizing pieces of four-mil (0.10 mm) gelatin-subbed polyester film base (ethylene glycol terephthalate) onto which was hand-coated, using a wire wound coating rod, a layer of a radiation-polymerizable composition including a temporary crosslinking agent, according to the present invention. The radiation-polymerizable composition comprised a mixture of acrylic acid (AA), a second comonomer, diacetone acrylamide (DAA), and an organotin compound included in the polymerizable composition as the temporary crosslinking agent. The weight ratios of the components of the composition are indicated in Table A below. In each instance, the amount of radiation-polymerizable composition coated onto the polyester support sheet also is set forth in Table A in g/m$^2$. The coated samples were subjected to polymerizing radiation by passing the samples on a carrier web beneath a source of ionizing irradiation. In each sample, the coated polyester pieces were subject, after coating the radiation-polymerizable composition, to an inert atmosphere of nitrogen so as to maintain the monitored level of oxygen below a concentration of 500 ppm. The radiation employed was a curtain of ionizing irradiation from a wire filament electron source, commercially available as the Electrocurtain system from Energy Sciences, Inc., Woburn, Mass. The electron beams from the wire filament source were passed through a beam window in the shielding cylinder and onto the continuously advancing coated pieces on the carrier web, thereby effecting polymerization of the coating. The dosages, expressed in megarads, and line speed of the web are listed in Table A.

The resulting sheet materials supporting the bonded layer of polymeric acid were each evaluated for content of residual monomers (AA and DAA), and water soluble acid content, and observed for lacing characteristics.

The presence of residual AA and DAA monomers in each sample was determined using gas chromatographic techniques. A sample of measured area was extracted with methanol and the extract was injected into a gas chromatograph. The percent residual monomer was calculated by integration of sample peak area and comparison with peak areas corresponding to known monomer standards. The residual monomer is reported in Table A as the percentage in the sample based on the amount of monomer in the coating composition.

Water-soluble acid content was determined by placing a sample piece of coated sheet material in a beaker of a distilled water and stirring for two hours. The size of each sample tested was six square inches (38.7 mm$^2$). The resulting water solution, containing any acid dissolved from the sample piece, was titrated with standardized 0.1 N potassium hydroxide solution. The amount of alkali consumed by titration is expressed in milliequivalents. By comparison of the amount of alkali consumed with the amount of acid present in the comonomer composition from which the sample was prepared, the percentage of water soluble acid in the sample may be calculated. This figure is reported in Table A.

Lacing or reticulation is determined by observation of the sample coating after exposure to alkaline processing composition. Each test sample was superposed in sandwich-like fashion on a transparent element comprising a cellulose triacetate film base having a coating of crosslinked gelatin at a coverage of 300 mg/ft$^2$ (3229 mg/m$^2$). An aqueous alkaline processing composition, having a pH of about 14 and containing potassium hydroxide, carboxymethyl hydroxyethyl cellulose thickening agent and benzotriazole was spread at a 0.003 in (0.076 mm) gap between the above-described superposed elements. The sample then was observed for about a 24 hour period for any lacing characteristics. Lacing or reticulation appears as an irregular buckling pattern on the sample surface. The amount of lacing as reported in Table A is graded on a scale of 0–2 [0=no lacing, 1=slight lacing, 2=lacing]. The absence of lacing is a clear indication that the crosslinked polymeric acid layer has hydrolyzed under the alkaline conditions of the processing composition. Permanent crosslinking causes irregular swelling under processing conditions which results in the lacing surface defects.

TABLE A

| Sample No. | AA/DAA/Cross-linker Weight Ratio | Coverage ($g/m^2$) | Line Speed (m/min) | Dosage (Megarads) | Residual AA (%) | Residual DAA (%) | Soluble Acid (%) | Lacing |
|---|---|---|---|---|---|---|---|---|
| 1 (Control) | 80/20/0 | 19.50 | 26.8 | 4.0 | 1.1 | 37.5 | 37.3 | 0 |
| 2 | 76/19/5[1] | 19.76 | 26.8 | 4.0 | 0.1 | 19.5 | 15.0 | 0 |
| 3 | 72/18/10[1] | 20.51 | 26.8 | 4.0 | 0.3 | 26.8 | 6.7 | 0 |
| 4 | 60/15/25[1] | 20.67 | 26.8 | 4.0 | 0.2 | 10.4 | 7.1 | 0 |
| 5 | 76/19/5[2] | 21.96 | 26.8 | 4.0 | — | — | 20.6 | 0 |

TABLE A NOTES
[1]dibutyltin oxide, obtained commercially under the trademark designation "FASCAT 4201" from M & T Chemicals, Inc.
[2]calcium acrylate, obtained commercially from Polysciences, Inc.

EXAMPLE II

A second set of samples of polyester sheet material having bonded thereto a polymeric acid layer containing temporary crosslinks was prepared using the materials, procedures and apparatus described in Example I. The results of evaluations of these test samples was reported in Table B below.

TABLE B

| Sample No. | AA/DAA/Cross-linker Weight Ratio | Coverage ($g/m^2$) | Line Speed (m/min) | Dosage (Megarads) | Residual AA (%) | Residual DAA (%) | Soluble Acid (%) | Lacing |
|---|---|---|---|---|---|---|---|---|
| 6 (Control) | 80/20/0 | 36.43 | 26.8 | 4.0 | 23.5 | 20.8 | 38.4 | 0 |
| 7 | 72/18/10[1] | 35.19 | 26.8 | 4.0 | 1.7 | 9.8 | 10.4 | 0 |
| 8 | 64/16/20[1] | 35.39 | 26.8 | 4.0 | 9.7 | 4.4 | 4.7 | 0 |
| 9 | 72/18/10[3] | 34.67 | 26.8 | 4.0 | 13.8 | 15.2 | 18.3 | 0 |
| 10 | 72/18/10[4] | 34.36 | 26.8 | 4.0 | 14.8 | 4.6 | 29.4 | 0 |
| 11 | 72/18/10[5] | 32.73 | 26.8 | 4.0 | 5.8 | 1.4 | 4.8 | 0 |

TABLE B NOTES
[1]dibutyltin oxide, obtained commercially under the trademark designation "FASCAT 4201" from M & T Chemicals, Inc.
[3]dibutyltin diacetate, obtained commercially under the designation "T-1" from M & T Chemicals, Inc.
[4]dibutyltin dilaurate, obtained commercially under the designation "T-12" from M & T Chemicals, Inc.
[5]butylchlorotin dihydroxide, obtained commercially under the trademark designation "FASCAT 4101" from M & T Chemicals, Inc.

EXAMPLE III

Samples of polyester sheet material having bonded thereto a polymeric acid layer comprising a temporary crosslinked acrylic acid copolymer were prepared using the materials, procedure and apparatus described above in Example I. Tertoctylacrylamide (TO), however, was employed as the comonomer in some samples in place of DAA. The crosslinker used was dioctyltinoxide (DOTO), obtained commercially under the designation T-813 from M & T Chemicals, Inc. The results of evaluations of these test samples are reported in Table C below.

Swelling, uptake of water by the sample piece, is determined first by weighing a measured section (6 $in^2$) of test sample and then soaking the sample in a beaker of distilled water for 1 minute. After drying the surface of the sample piece under a stream of nitrogen for about 30 seconds, the sample again is weighed. The weight gain, due to water absorbed by the sample, expressed as weight percent based on the original dry coating weight is reported in Table B. This swelling simulates swelling that would take place under conditions during film unit fabrication.

TABLE C

| Sample No. | AA/Comonomer/DOTO Weight Ratio | Coverage ($g/m^2$) | Line Speed (m/min) | Dosage (Megarads) | Residual AA (%) | Residual Comonomer (%) | Soluble Acid (%) | Swelling Water (%) | Lacing |
|---|---|---|---|---|---|---|---|---|---|
| 12 (Control) | 70/30DAA/0 | 35.86 | 30.5 | 4 | 1.6 | 6.9 | 5.4 | 66 | 0 |
| 13 | 67.5/27.5DAA/5 | 32.63 | 30.5 | 4 | 1.5 | 6.4 | 3.6 | 42 | 0 |
| 14 | 60/25DAA/15 | 32.65 | 30.5 | 4 | 0.8 | 5.5 | 2.0 | 1.3 | 0 |
| 15 | 52.5/22.5DAA/25 | 32.60 | 30.5 | 4 | 0 | 2.4 | 0.9 | 0.5 | 0 |
| 16 (Control) | 70/30TO/0 | 32.50 | 30.5 | 4 | 3.9 | 10.4 | 3.5 | 6 | 0 |
| 17 | 67.5/27.5TO/5 | 31.65 | 30.5 | 4 | 2.9 | 8.0 | 2.9 | 0.7 | 0 |
| 18 | 60/25TO/15 | 31.03 | 30.5 | 4 | 3.4 | 7.7 | 1.8 | 0.5 | 0 |
| 19 | 63/27TO/10 | 30.77 | 30.5 | 4 | 1.9 | 7.3 | 2.1 | 0.4 | 0 |

What is claimed is:

1. An element adapted for use in a film unit of a photographic diffusion transfer process which comprises a sheet-like support and a polymeric neutralizing layer bonded to said support, said polymeric neutralizing layer being a polymeric acid formed by radiation polymerization of a radiation-polymerizable composition and containing, within the polymeric layer, temporary cross-links from an organometallic cross-linking agent which effect resistance to nonalkaline hydrolysis under film unit assembly conditions and which are subject to substantial degradation under conditions of alkali hydrolysis during film unit processing.

2. The element of claim 1 wherein said organometallic cross-linking agent is an organotin compound.

3. The element of claim 2 wherein said organotin cross-linking agent is selected from the group consisting of organotin oxides, hydroxides, carboxylates and mixtures thereof.

4. The element of claim 3 wherein said organotin cross-linking agent is selected from the group consisting of dibutyltin oxide, dioctyltin oxide and butylstannoic acid.

5. The element of claim 1 wherein said radiation-polymerizable composition comprises an aliphatic ethylenically unsaturated carboxylic acid or anhydride.

6. The element of claim 5 wherein the radiation-polymerizable carboxylic acid is acrylic acid.

7. The element of claim 1 wherein said radiation-polymerizable composition comprises a mixture of acrylic acid and a comonomer selected from the group consisting of mono-N-substituted acrylamides, acrylate esters, methacrylate esters, and mixtures thereof.

8. The element of claim 7 wherein said comonomer is selected from the group consisting of diacetone acrylamide and t-octylacrylamide.

9. The element of claim 8 wherein the radiation polymerizable composition includes an organotin compound in an amount ranging from about 5 to about 25 mole percent.

10. The element of claim 9 wherein the radiation-polymerizable composition includes an organotin compound in an amount ranging from about 5 to about 10 mole percent.

11. The element of claim 10 wherein the organotin compound is selected from the group consisting of organotin oxides, hydroxides, carboxylates and mixtures thereof.

12. The element of claim 11 wherein the organotin compound is selected from the group consisting of dibutyltin oxide, dioctyltin oxide and butylstannoic acid.

13. A photographic film unit for forming a diffusion transfer image comprising at least one sheet-like support; an image-receiving layer; at least one photosensitive silver halide emulsion layer, each said silver halide emulsion having associated therewith an image-forming material; and means for providing a processing composition for developing each said silver halide emulsion after photoexposure and for forming a diffusion transfer image in said image-receiving layer; and a polymeric neutralizing layer; said polymeric neutralizing layer, bonded to at least one said sheet-like support, being a polymeric acid formed by radiation polymerization of a radiation-polymerizable composition and containing, within the polymeric layer, temporary cross-links from an organometallic cross-linking agent which effect resistance to nonalkaline hydrolysis and which are subject to substantial degradation under conditions of alkali hydrolysis during film unit processing.

14. The element of claim 13 wherein said organometallic cross-linking agent is an organotin compound.

15. The element of claim 14 wherein said organotin cross-linking agent is selected from the group consisting of organotin oxides, hydroxides, carboxylates and mixtures thereof.

16. The element of claim 14 wherein said organotin cross-linking agent is selected from the group consisting of dibutylin oxide, dioctyltin oxide and butylstannoic acid.

17. The element of claim 13 wherein said radiation-polymerizable composition comprises an aliphatic ethylenically unsaturated carboxylic acid or anhydride.

18. The element of claim 17 wherein the radiation-polymerizable carboxylic acid is acrylic acid.

19. The element of claim 18 wherein said radiation-polymerizable composition comprises a mixture of acrylic acid and a comonomer selected from the group consisting of mono-N-substituted acrylamides, acrylate esters, methacrylate esters and mixtures thereof.

20. The element of claim 19 wherein said comonomer is selected from the group consisting of diacetone acrylamide and t-octylacrylamide.

21. The element of claim 20 wherein the radiation-polymerizable composition includes an organotin compounds in an amount ranging from about 5 to about 25 mole percent.

22. The element of claim 21 wherein the radiation-polymerizable composition includes an organotin compound in an amount ranging from about 5 to about 10 mole percent.

23. The element of claim 22 wherein the organotin compound is selected from the group consisting of organotin oxides, hydroxides, carboxylates and mixtures thereof.

24. The element of claim 23 wherein the organotin compound is selected from the group consisting of dibutyltin oxide, dioctyltin oxide and butylstannoic acid.

25. A photosensitive element adapted for use in a film unit of a photographic diffusion transfer process comprising a sheet-like support and at least one photosensitive silver halide emulsion layer, each said silver halide emulsion having associated therewith an image-forming material; and a polymeric neutralizing layer bonded to said support, said polymeric neutralizing layer being a polymeric acid formed by radiation polymerization of a radiation-polymerizable composition and containing, within the polymeric layer, temporary cross-links from an organometallic cross-linking agent which resist nonalkaline hydrolysis and which are subject to substantial degradation under conditions of alkali hydrolysis during photosensitive element processing.

26. The element of claim 25 wherein said organometallic cross-linking agent is an organometallic compound.

27. The element of claim 26 wherein said organotin cross-linking agent is selected from the group consisting of organotin oxides, hydroxides, carboxylates and mixtures thereof.

28. The element of claim 27 wherein said organotin cross-linking agent is selected from the group consisting of dibutyltin oxide, dioctyltin oxide and butylstannoic acid.

29. The element of claim 25 wherein said radiation-polymerizable composition comprises an aliphatic ethylenically unsaturated carboxylic acid or anhydride.

30. The element of claim 29 wherein the radiation-polymerizable carboxylic acid is acrylic acid.

31. The element of claim 30 wherein said radiation-polymerizable composition comprises a mixture of acrylic acid and a comonomer selected from the group consisting of mono-N-substituted acrylamides, acrylate ester, methacrylate esters, and mixtures thereof.

32. The element of claim 31 wherein said comonomer is selected from the group consisting of diacetone acrylamide and t-octylacrylamide.

33. The element of claim 32 wherein the radiation-polymerizable composition includes an organotin compound in an amount ranging from about 5 to about 25 mole percent.

34. The element of claim 33 wherein the radiation-polymerizable composition includes an organotin compound in an amount ranging from about 5 to about 10 mole percent.

35. The element of claim 34 wherein the organotin compound is selected from the group consisting of organotin oxides, hydroxides, carboxylates and mixtures thereof.

36. The element of claim 35 wherein the organotin compound is selected from the group consisting of dibutyltin oxide, dioctyltin oxide and butylstannoic acid.

* * * * *